United States Patent [19]

Grange

[11] 4,032,368

[45] June 28, 1977

[54] INTERCRITICAL-CYCLE ANNEALING

[75] Inventor: Raymond A. Grange, Washington Township, Westmoreland County, Pa.

[73] Assignee: United States Steel Corporation, Pittsburgh, Pa.

[22] Filed: Feb. 13, 1975

[21] Appl. No.: 549,631

Related U.S. Application Data

[63] Continuation of Ser. No. 295,391, Oct. 5, 1972, abandoned.

[52] U.S. Cl. ..... 148/134

[51] Int. Cl.[2] ..... C21D 1/00

[58] Field of Search ..... 148/2, 12, 13, 134, 148/143, 144

[56] References Cited

UNITED STATES PATENTS

| | | | |
|---|---|---|---|
| 1,733,669 | 10/1929 | Makita | 148/134 |
| 2,563,672 | 8/1951 | Boyce | 148/143 X |
| 2,664,369 | 12/1953 | Kiefer | 148/143 X |
| 2,779,698 | 1/1957 | Boughman et al. | 148/143 |
| 3,028,270 | 4/1962 | Morita | 148/143 |
| 3,178,324 | 4/1965 | Grange et al. | 148/143 |
| 3,288,657 | 11/1966 | Morita et al. | 148/143 |
| 3,370,994 | 2/1968 | Konkol | 148/143 |
| 3,732,127 | 5/1973 | Furgason | 148/143 X |

OTHER PUBLICATIONS

Metals Handbook, 8th ed., 1964, pp. 56–64.

*Primary Examiner*—C. Lovell
*Attorney, Agent, or Firm*—Arthur J. Greif

[57] ABSTRACT

Hypoeutectoid steel is heated to an intercritical temperature to produce a microstructure of about 30–50% austenite. The steel is then cooled as rapidly as feasible to a temperature below $A_s$ and held at temperature to transform the austenitic portion. Such transformation may occur either in the minimum of the pearlite region (~1200° F) or in the bainite region (~800° F).

8 Claims, 8 Drawing Figures

FAST

INTERMEDIATE

SLOW

INTERCRITICAL-CYCLE ANNEALING

This is a continuation of application Ser. No. 295,391, filed Oct. 5, 1972, now abandoned.

This invention is related to the annealing of hypoeutectoid steels which exhibit a significant two phase region of ferrite and austenite, and is particularly related to hypoeutectoid steels with less than about 5% total alloy content.

Annealing of steel is generally practices to soften the product, thereby enhancing formability, machinability, etc. In addition to achieving softening, it is generally requisite that there be substantially no martensite in the final product. In attempting to eliminate martensite, the necessary transformation of residual austenite is often a more serious problem than attaining sufficiently low hardness. This is especially true in the presence of banding (microsegragation) which is generally present in commercial steel products and tending to be more severe in the higher alloy steels. The microstructure of the final product is often an important factor. Thus, while hardness specifications can be met with various martensite-free microstructures, they will often exhibit differing degrees of cold formability and machinability.

Presently, hypoeutectoid steels are annealed by heating above the $A_f$ to convert all ferrite to austenite and then cooling very slowly. Variations in the cooling cycle are practiced, but with the possible exception of some undissolved carbides, the anneal always begins with the steel in the fully austenitic condition. Subsequently, the steel is either full annealed or cycle annealed. In the former the steel is very slowly cooled, (e.g. to about 1100° F) to insure complete austenite transformation and the avoidance of any martensite in the final product. In the latter procedure, the steel is cooled and then held at a constant subcritical temperature as close to the $A_s$ as is feasible (e.g. 1200° F). In either case, a period of several days is often required to complete the anneal. Such long times are rather costly due to the considerably amount of thermal energy which must be supplied.

It is therefore an object of this invention to provide a method for significantly reducing the time required in annealing hypoeutectoid steels.

It is another object of this invention to provide an annealing treatment which will provide significant reduction in the amount of thermal energy expended.

It is a further object of this invention to reduce the amount of scaling and decarburization attendant the annealing of hypoeutectoid steels.

It is yet another object of this invention to provide an annealed steel with a marked reduction in banding.

Figure 1:
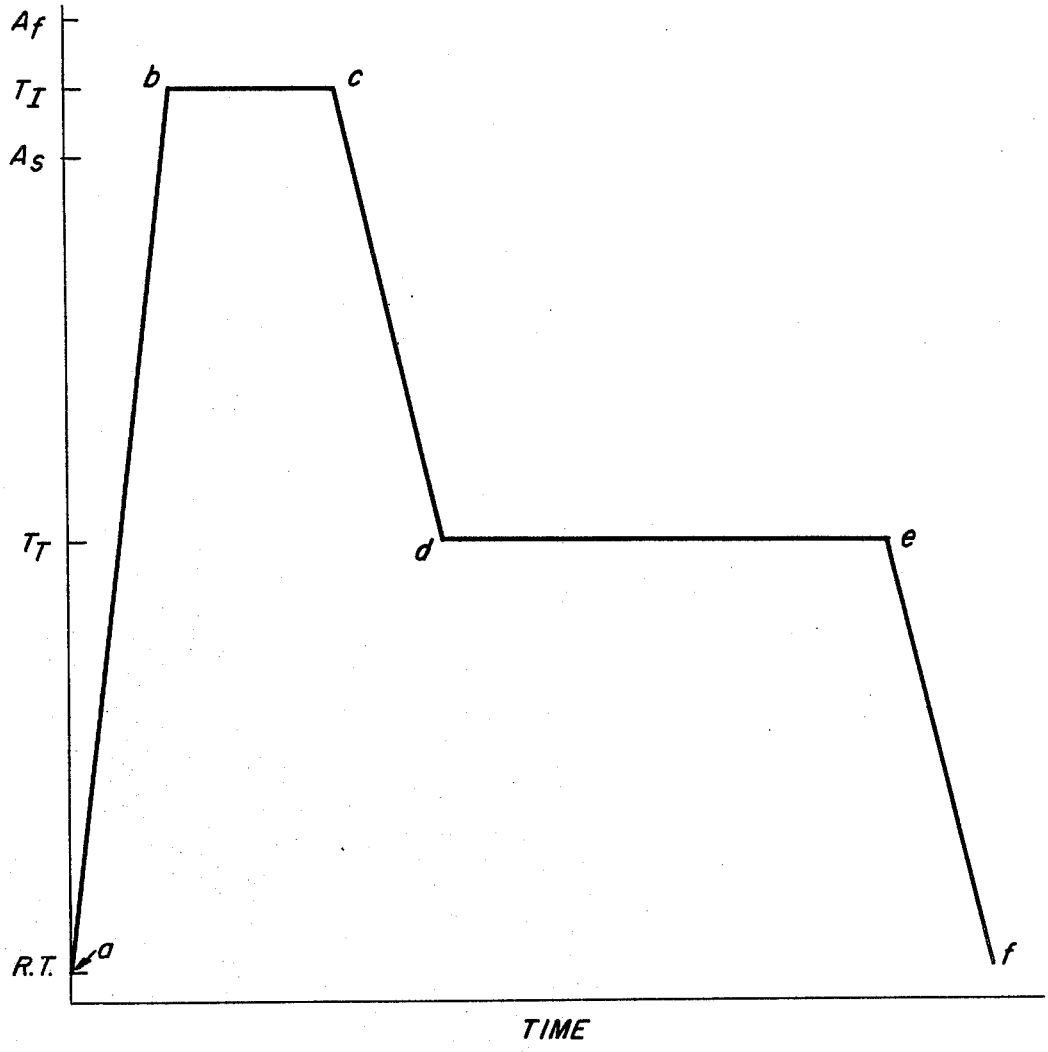
Figure 2:
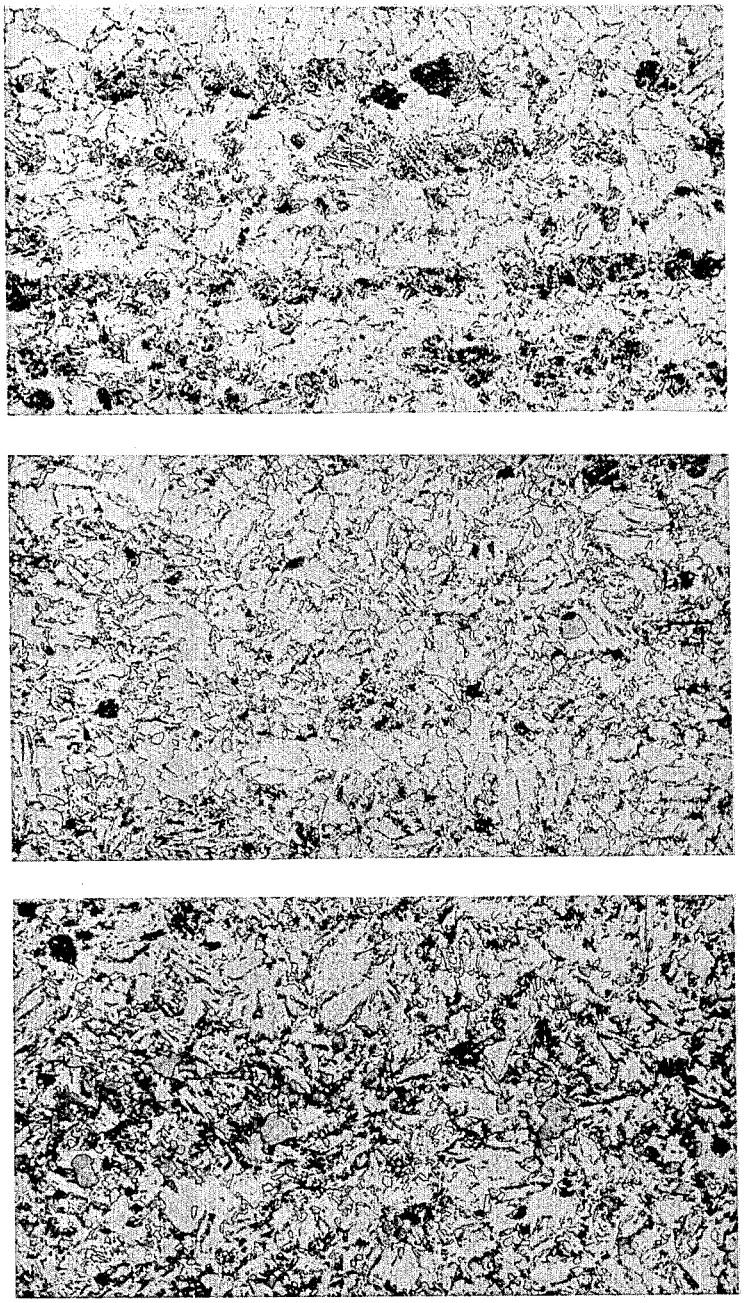
Figure 3:
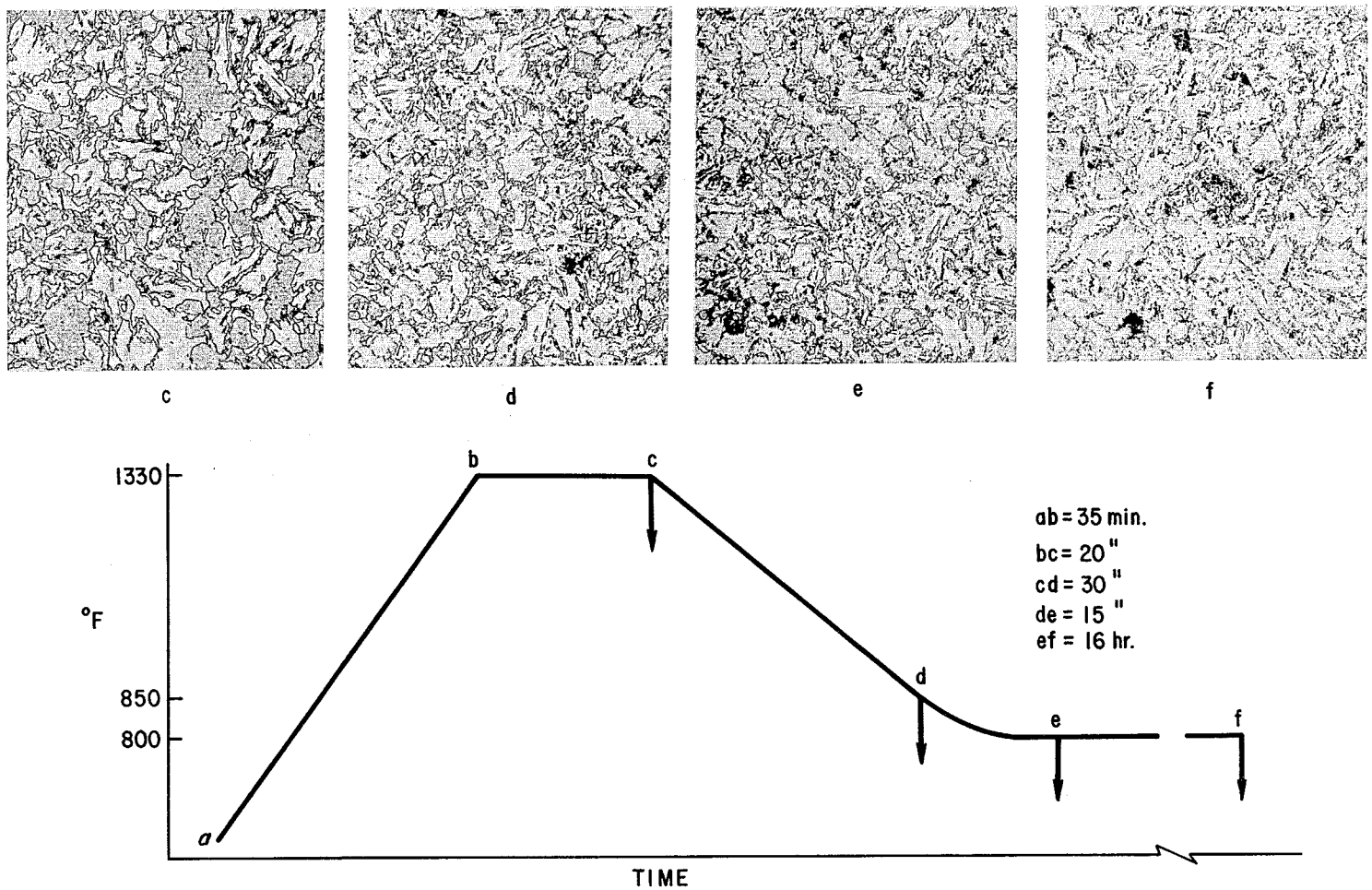
Figure 4A:
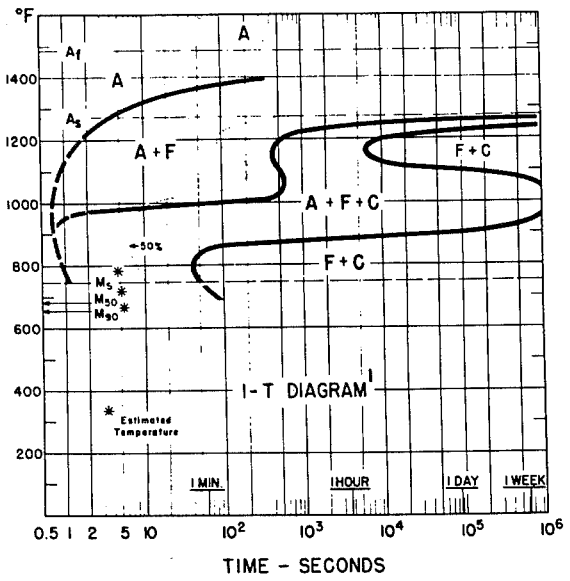
Figure 4B:
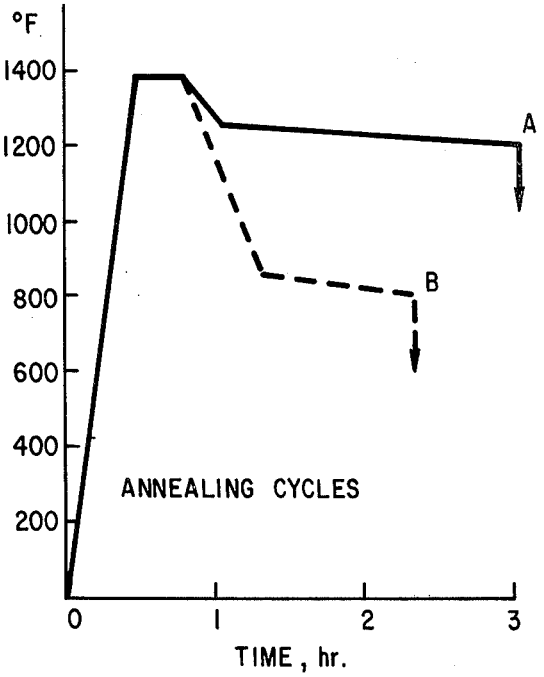
Figure 5A:
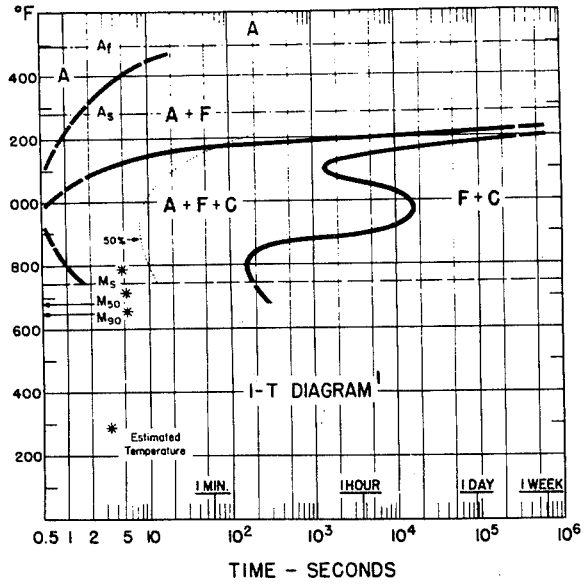
Figure 5B:
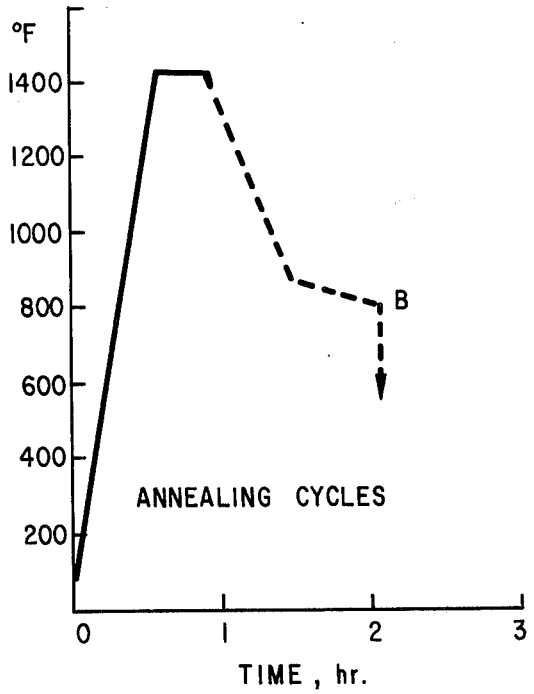
Figure 6:
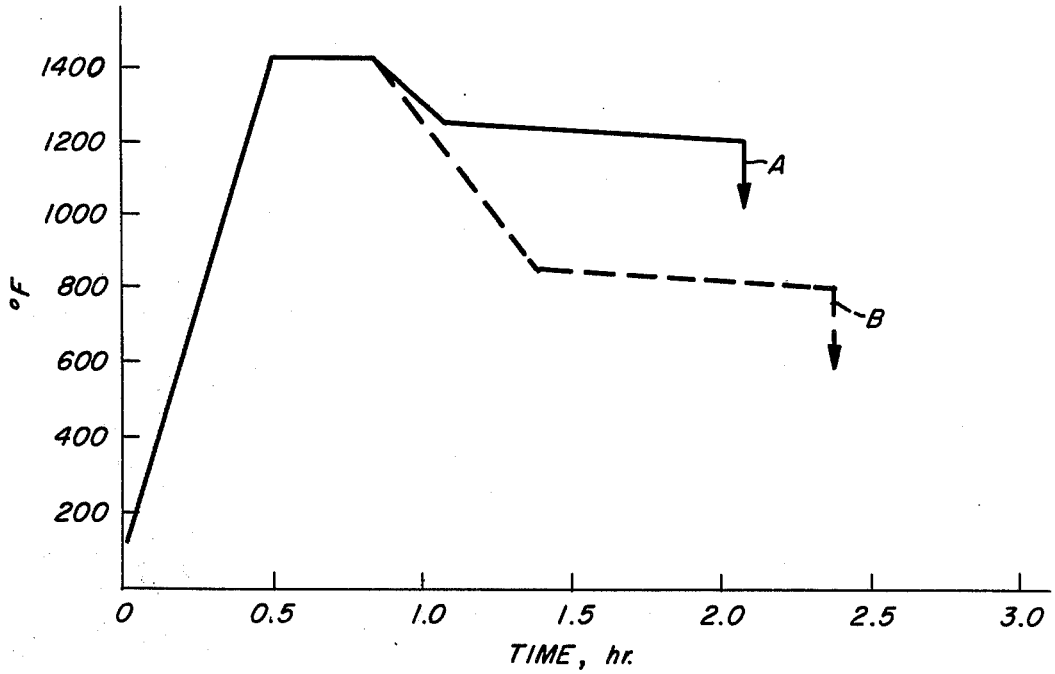

These and other objects and advantages of the method of this invention will be more readily understood from the following description, taken in conjunction with the appended claims and drawings, in which:

FIG. 1 is a schematic illustration of the different steps which make up the instant annealing treatment, FIG. 2 is a microphotographic comparison of the effect of cooling rate on austenite stabilization, FIG. 3 shows the annealing cycle and microstructure of four samples, each quenched at a different stage in the intercritical-cycle anneal, FIGS. 4*a* and 4*b* show the I-T diagram and to annealing cycles for an AISI 4317 steel, respectively, FIG. 5*a* and 5*b* shows the I-T diagram and annealing cycle for an AISI 1320 steel, respectively, and FIG. 6 shows two annealing cycles, in accord with the instant invention, for an AISI 4118 steel.

For a better undertanding of the instant invention, it is desirable to consider the annealing treatment of this invention as comprising five steps and two temperature levels as shown in FIG. 1. These seven variables, are designated as follows:

$T_I$ . . . intercritical temperature $T_T$ . . . transformation temperature used to eliminate austenite

*ab* . . . time to heat to $T_I$

*bc* . . . holding time at $T_I$

*cd* . . . time to cool from $T_I$ to $T_T$

*de* . . . holding time at $T_T$

*ef* . . . time to cool to ambient temperature.

Of these seven variables, *ef* may logically be dismissed as having no effect because, in a successful anneal, transformation will be complete at point *e*. The effect of the remaining six variables will be discussed below.

*ab*, time to heat to $T_I$ and *bc*, holding time at $T_I$

In the interest of minimizing total annealing time, it is desirable to heat as fast as possible and to only hold at temperature until the desired amount of ferrite has transformed to austenite. More importantly, it was determined that slowly heated samples were more stable at $T_T$, thus requiring significant additional time to complete the transformation at $T_T$.

Selection of $T_I$

The intercritical temperature to which a steel is heated should develop 30–50% austenite, with the balance ferrite. $T_I$ will therefore depend on the chemical composition of the steel, i.e. a temperature somewhere between the $A_s$ and $A_f$ of the particular steel. A structure containing, for example, 40% austenite could be developed at a temperature just below the $A_f$. The use of such a temperature would, however, require rather precise and often impractical control of heat-up rate and holding time. Therefore, for commercial utilization, $T_I$ will generally be midway between $A_s$ and $A_f$, i.e. $T_I = A_s + A_f/2$. $T_I$ may be determined empirically; however, for standard grades of carbon and low-alloy steels $A_s$ and $A_f$ may be calculated (with sufficient accuracy for annealing) from chemical composition. Thus, the temperature at which austenite will begin to form is given by:

$$A_s(°F) = 1333 - 25(\%Mn) + 40(\%Si) + 42(\%Cr)$$

and, the temperature at which all ferrite can be converted to austenite is given by:

$$A_f(°F) = 1570 + 323(\%C) - 25(\%Mn) + 80(\%Si) - 32(\%Ni) - 3(\%Cr)$$

It is generally not possible to control temperature to an exact value, but is desirable that $T_I$ not vary by more than ±25° F and preferably not more than ±15° F.

Selection of $T_T$ $T_T$ may, of course be any temperature at which austenite completely transforms to ferrite and iron carbide. However, the total annealing period will be significantly shortened if the temperature employed is one in which austenite transforms in the shortest time. Of course, this temperature varies amoung different grades of steel. An isothermal transformation diagram of the particular steel in question (or a diagram of one resembling it in composition) will be helpful in selecting the most preferable temperature. (See "Atlas of Isothermal Trans. Diagrams", U.S. Steel Corp., 1963.) For example, the I-T diagram of AISI 4817 has a minimum in completion of transformation at 800° F, which therefore is the logical choice for $T_T$. A second, though much longer, minimum occurs in this steel at 1125° F, which might be chosen if even greater softening is required. Some grades have two, more or less, equal minima — one in the pearlite region and one in the bainite region. In such a case, the pearlite minimum is the logical choice, since time is saved in cooling from $T_1$ to $T_T$. However, in a number of instances, somewhat higher hardness may be tolerable or even desirable, in which case the bainite minimum will be selected. In carbon and certain lower alloy steels, there may be no pronounced minimum above 1100° F. This would enable the use of any temperature above 1100° F, with a softer product resulting as $T_T$ is higher. At either of the above minimums, $T_T$ should generally be held to within ±50° F of the ending line of the I-T diagram and preferably held to within ±25° F of said ending line minimum.

*cd*, the cooling rate, $T_I$ to $T_T$

As in the case of the heat-up rate *ab*, the cooling from $T_I$ should be as fast as possible. Slow cooling naturally wastes time. More importantly, it has been found that the time required for completion of transformation of austenite at $T_T$ is markedly increased as the cooling rate is slower. This is surprising in view of the long standing tradition in annealing of steel which holds that slower cooling will decrease the amount of residual martensite. It has been found, however, that slower cooling partitions more carbon (and possibly alloying elements) to the residual austenite, with the result that marked stabilization occurs.

The following example is offered as an aid in understanding this effect. Three samples of AISI 4817 steel were annealed according to the method of this invention, under the following conditions:

| ab | $T_I$ | bc | cd | $T_T$ | de | Total |
|---|---|---|---|---|---|---|
| 32 min. | 1330° F | 20 min. | 1 min. | 850/800° F | 10 min. | 63 min. |
| " | " | " | 30 min. | " | " | 92 min. |
| " | " | " | 81 min. | " | " | 143 min. |

FIG. 2 shows the microstructure of each of the above specimens. With the "fast" cooling (*cd*=1 minute) the steel is fully annealed, in that no martensite is present. With "intermediate" cooling (*cd*=30 minutes), about 2% martensite remains. Martensite increases to about 5% with the "slow" cooling rate of 81 minutes. The reason for this difference may be seen by reference to FIG. 3, which shows the microstructure of four samples quenched at indicated stages in the anneal in which a cooling rate of 30 minutes was employed. Note, that during cooling there is a considerable reduction in the amount of austenite (compare sample "*c*" with "*d*"). However, because of stabilization due to partitioning, the time to transform residual austenite, despite the presence of less of it, is greatly increased. Thus, while there is only a few percent of austenite at "*e*", a 16-hour holding period (*ef*) was required to completely transform it. Thus, to completely eliminate martensite in the final product, the total anneal was extended to about 18 hours (with a *cd* cooling time of 30 minutes). On the other hand, when *cd* was 1 minute, martensite elimination was achieved in a total anneal of little more than 1 hour.

It may therefore be seen that every effort should be made, in designing equipment for annealing, to reduce the cooling time *cd*. Since the $T_I$ and $T_T$ temperatures will vary greatly for different steels, it is difficult to specify a minimum cooling rate. For any given steel, the minimum cooling rate should be faster if $T_T$ is chosen to be in the bainite region, rather than in the pearlite region. However, the cooling rate should be sufficiently rapid to prevent the "undue" stabilization of the austenite. Austenite may be said to be "unduly" stabilized if it requires more than about 3 hours to substantially complete transformation at the bainite minimum for the particular steel in question. As a general guide, cooling rate, *cd*, should be equal to or greater than that given by the equation:

$$cd = (T_I - T_T)/60$$

where *cd* is in °F/min.; and $T_I$ and $T_T$ are in °F.

In accord with the principles given above,, several grades of steel were annealed using the method of this invention. Samples were contained in a 3 inch diameter graphite tube and transferred from one furnace at $T_I$ to another at $T_T$, i.e. furnace cooled. Naturally, the avoidance of quenching (e.g. by air or water blasts) did not product the shortest possible cycling. However, due to the small specimens used in these experiments, this procedure was employed because it was more closely representative of the rates achievable in commercial annealing (and desirably utilizing quenching).

AISI 4317

The I-T diagram of this steel is shown in FIG. 4*a* and 4*b*. On the basis of the two minima in the ending line, two annealing cycles were given. In cycle "A", $T_T$ was chosen at the pearlite minimum, whereas in "B", $T_T$ was at the bainite minimum. Both cycles fully annealed the steel, since no martensite was detected in either of the final products. As expected, the product of cycle "A" was softer (78.5 $R_B$) than that of cycle "B" (87 $R_B$). Thus, in view on only slightly longer total annealing time, cycle "A" would generally be chosen in preference to cycle "B". AISI 4317 is a steel with a relative high hardenability. Thus, the fact that martensite could be eliminated, and the steel satisfactorily softened in only a 3 hour cycle, clearly demonstrates the marked saving in time possible with the method of this invention.

AISI 1320

The 1.88% Mn content of this steel makes it difficult to anneal by conventional methods. The sample was annealed in 2 hours [FIG. 5(*b*)] employing a $T_T$ corresponding to that of the bainite minimum of the I-T diagram [FIG. 5(*a*)] for this steel. No martensite was detected in the final product which exhibited a $R_B$ hardness of 87. As before, if a softer product were desired, this could be achieved in a slightly longer time, by employing a $T_T$ (e.g. 1100° F) near the pearlite minimum of the ending line for this steel. It is additionally notable that, while AISI 1320 is a grade very prone to severe banding, there was virtually no noticeable banding on the above sample.

AISI 4118

A I-T diagram for this grade was not available, hence $T_T$ was arbitrarily selected at 1250°/1200° F in cycle "A" and 850°/800° F in cycle "B" (FIG. 6). Both cycles developed, in about 2 hours, a fully annealed microstructure with little hardness difference ("*A*" = 73 $R_B$ and "*B*" = 75 $R_B$). Since cycle A is faster in this instance, it would be preferably in most instances.

The intercritical cycle annealing of this invention is of greatest commercial interest in annealing low-carbon steels wherein the relatively extensive $A_s$–$A_f$ range obviates the need for precise temperature control at $T_I$. For practical considerations, it is desirable that the composition (alloy content) be such that the steel exhibit an $A_s$–$A_f$ range greater than about 100° F. The retention of 50–70% ferrite at $T_I$ makes it possible to achieve low hardness even when the 30–50% austenite is transformed to relatively hard bainite. In the lower carbon steels (below 0.15% C), the product achieved using the pearlite $T_T$ minimum may be too soft under some circumstances, thus the bainite $T_T$ minimum would be employed. If the latter cycle is employed, the method of this invention will most often reduce the duration of the anneal (as compared with conventional practice) by greater than an order of magnitude. In either case, the method of this invention will save considerable cost in time and thermal energy expended. This reduced time will also significantly decrease the degree of scaling and decarburization.

I claim:

1. A method for the annealing of hypoeutectoid steels which exhibit an $A_s$–$A_f$ region greater than about 100° F, which comprises, a. holding said steel at an intercritical temperature for a time sufficient to form a microstructure containing about 30–50% austenite and 70–50% ferrite, and b. cooling said steel to a temperature within the range ($T_T$–50° F) to ($T_T$ + 50° F) at a rate, in °F/min., which is equal to or greater than $T_I$–$T_T$/60, in which $T_T$ is a temperature wherein the ending line of I-T diagram for said steel exhibits a minimum in time, and in which $T_I$=$A_s$+$A_f$/2, c. holding the steel within said temperature range for a time sufficient to transform all said austenite, in order that no martensite will be present on cooling to ambient temperature.

2. The method of claim 1, wherein said steel is initially at a temperature below the $M_s$ of the steel and is thereafter heated to said intercritical temperature.

3. The method of claim 2, wherein said intercritical hold is at a temperature within the range of from ($T_I$–25° F) to ($T_I$ + 25° F).

4. The method of claim 3, wherein the heating of said steel to said temperature, $T_I$, is accomplished in a period of less than about 3 hours.

5. The method of claim 4, wherein the hold of step (c) is at a temperature in which the ending line of the I-T diagram for said steel exhibits a minimum in the pearlite region.

6. The method of claim 5, wherein the hold of step (c) is at a temperature within the range of from ($T_T$ − 25° F) to ($T_T$ + 25° F).

7. The method of claim 4, wherein the hold of step (c) is at a temperature in which the ending line of the I–T diagram for said steel exhibits a minimum in the bainite region.

8. The method of claim 7, wherein the hold of step (c) is at a temperature within the range of from ($T_T$ − 25° F) to ($T_T$ + 25° F).

* * * * *

UNITED STATES PATENT OFFICE

CERTIFICATE OF CORRECTION

Patent No. 4,032,368 Dated June 28, 1977

Inventor(s) Raymond A. Grange

It is certified that error appears in the above-identified patent and that said Letters Patent are hereby corrected as shown below:

Column 1, line 10, "practices" should be -- practiced --,

Column 1, line 65, "to" should be -- two --,

Column 2, line 51, "$A_s$(°F) = 1333-25(%Mn) +40(%Si) +42(%Cr)" should read -- $A_s$(°F) = 1333-25(%Mn) +40(%Si) -26(%Ni) +42(%Cr) --, Column 2, line 55, "$A_f$(°F) = 1570 +323(%C) -25(%Mn) +80(%Si) -32(%Ni) -3(%Cr)" should read -- $A_f$(°F) = 1570 -323(%C) -25(%Mn) +80(%Si) -32(%Ni) -3(%Cr) --, Column 4, line 30, "product" should be -- produce --,

UNITED STATES PATENT OFFICE

CERTIFICATE OF CORRECTION

Patent No. 4,032,368 Dated June 28, 1977

Inventor(s) Raymond A. Grange

It is certified that error appears in the above-identified patent and that said Letters Patent are hereby corrected as shown below:

Column 5, line 9, "preferably" should be -- preferable --,

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*